United States Patent [19]

Throner

[11] 4,414,880

[45] Nov. 15, 1983

[54] GAS REGULATED COMPENSATING VALVE MECHANISM FOR FIREARMS

[75] Inventor: Guy C. Throner, Upper Arlington, Ohio

[73] Assignee: Battelle Memorial Institute, Columbus, Ohio

[21] Appl. No.: 337,182

[22] Filed: Jan. 5, 1982

[51] Int. Cl.[3] ..... F41D 5/08

[52] U.S. Cl. ..... 89/193

[58] Field of Search ..... 89/193

[56] References Cited

U.S. PATENT DOCUMENTS 2,482,880 9/1949 Sefried ..... 89/193

*Primary Examiner*—Stephen C. Bentley

*Attorney, Agent, or Firm*—Robert B. Watkins; Philip M. Dunson

[57] ABSTRACT

An apparatus for the activation of a gas-operated reloading mechanism of a firearm comprising a cylindrical cartridge magazine housing along with a pressure sensing and regulating means, using a series of three chambers and a moveable piston which regulates a pressure controlling valve. Gas pressure from an exploding cartridge in the barrel of the firearm is bled into a first chamber through a passage where it displaces a piston attached to a moveable tapered stem. The tapered stem protrudes into an orifice creating a valve combination which regulates the flow of gas into a chamber which activates the reloading mechanism. High or low pressures within the gun barrel are equally capable of operating the reloading mechanism with reliability and without damage to parts.

7 Claims, 2 Drawing Figures

GAS REGULATED COMPENSATING VALVE MECHANISM FOR FIREARMS

SUMMARY OF THE INVENTION

This invention relates to a gas operated apparatus for activating the reloading mechanism of firearms, and more particularly, a semi-automatic shotgun or rifle. The firearm is of the type that upon the firing of a cartridge within a chamber in the firearm, gas pressure is generated within the barrel and a portion of this pressure is diverted to automatically reload the chamber.

Briefly and in summary, in the construction of this invention, a cylindrical magazine housing is attached beneath the barrel of a firearm and is constructed with a gas pressure regulating valve assembly, a longitudinally moveable piston and a cartridge magazine. The apparatus comprises a gas pressure regulating valve assembly which operates when gas from the explosion of a cartridge in the barrel is bled off through an interconnecting duct from the barrel to a pressure sensing chamber. The magnitude of this pressure operates a valve in a second chamber, governing the pressure of gases transmitted to a third piston activating chamber. The sliding movement of this piston operates a mechanism which reloads another shell into the firing chamber. The reaction of this valve to the sensed gas pressure insures that a proper pressure necessary to activate the reloading mechanism is present, and prevents excessive pressure from entering the piston chamber and exerting damaging force on the reloading mechanism. Concommitantly, the excess gas pressure is retained within the firearm barrel, where it enhances the force propelling the projectile or load.

The apparatus of this invention is an assembly comprising:

A. A hollow magazine housing which is attached to the underside of a barrel of a firearm and encloses all of the working components of the invention as well as the operating piston of the magazine. A gas conveying duct permits communication of gas pressure from the barrel to the interior of the magazine where there is a series of three chambers coaxial with, and sequentially arranged within, the magazine housing. The chambers are in fluid communication with the gas pressure of the barrel through a gas conveying duct B. A gas pressure sensing first chamber means in fluid communication with a head end of a regulator first piston. The first piston is reciprocatingly retained within a cylinder coaxial with the first chamber and biased in one direction by an elastic spring means and biased in the opposite direction by the gas pressure in the first chamber. The first piston has a portion forming a stem of variable cross-section on the opposite end to the head end C. A gas regulating second chamber in fluid communication with the first chamber through at least one aperture and having an orifice coaxial with the stem, the stem being positioned within the orifice, and the orifice providing communication between the second chamber and a third chamber D. The third chamber operably containing a second piston which is connected to the loading mechanism of the firearm—and E. The stem having an elongated, tapered end portion which is longitudinally moveable and positionable in the orifice according to the pressure variations in the first and second chambers, so that it regulates the rate of gas flow and pressure in the third chamber.

The method of using gas pressure from an exploding cartridge to reload a semi-automatic or automatic firearm is well known in the firearms industry. Because of the wide variety of gas pressure generated among the various types of ammunition and also the wide variations within the shells of a single manufacturer, it has been a continuing problem to design a mechanism which is capable of operating in all circumstances. A mechanism capable of operating at low pressures through the use of precision parts and assembly is often damaged under high pressure while a mechanism capable of withstanding high pressure is often ineffective to reliably operate in low pressure circumstances. In the prior art, various mechanical means have been tried, frequently employing manual adjustment for various situations. In practice, this readjustment is often overlooked by the firearm user, resulting in damage to the mechanism or failure to operate the firearm.

Automatic methods which allow gas pressure within the activation chamber to build until a designed limit is attained and then vent the excess pressure have been tried, but these methods generally incorporate additional complicating mechanisms and have proven to be prone to damage while attempting to contain the high pressure explosive gas that is momentarily in fluid communication with the activating mechanism. They have the further disadvantages of drawing off excess propellent power from the barrel and also of venting the noxious gas in close proximity to the shooter and those nearby.

U.S. Pats. No. 3,127,812—-Into, et al and 3,968,727—-Hyytinen, are examples of prior patent art apparatus for controlling the gas pressure in a gas operated reloading mechanism for firearms. These patents have a spring-loaded pressure relief valve mechanism which vents excess pressure to the atmosphere to provide a standard selected pressure on the reloading mechanism when the firearm is used with different cartridge loads.

This invention is distinguished from these patents since among other things, this invention does not vent the excess forces from heavier loads, but rather retains the excess forces within the barrel and as part of the propelling charge.

More recent methods have attempted to use manually changed orifices to regulate the gas pressure without self-regulating means but these have been impractical because the shooter often fails to change the setting when employing different powder loads.

It is an object of this invention to overcome these disadvantages and provide a gas regulating mechanism capable of operating under a wide range of gas pressure circumstances while using this pressure efficiently and in addition, preventing the venting of excess gas in the immediate vicinity of the shooter, while eliminating manual adjustments.

It is a further purpose of this invention to accomplish these objectives while minimizing the mechanical complexity of the apparatus and thereby increasing reliability and operating life.

The foregoing and other advantages of the invention will become apparent from the following disclosure in which a preferred embodiment of the invention is described in detail and illustrated in the accompanying drawings. It is contemplated that variations in procedures, structural features and arrangement of parts may appear to the person skilled in the art without departing from the scope or sacrificing any of the advantages of the invention.

DETAILED DESCRIPTION OF THE INVENTION

Figure 1:
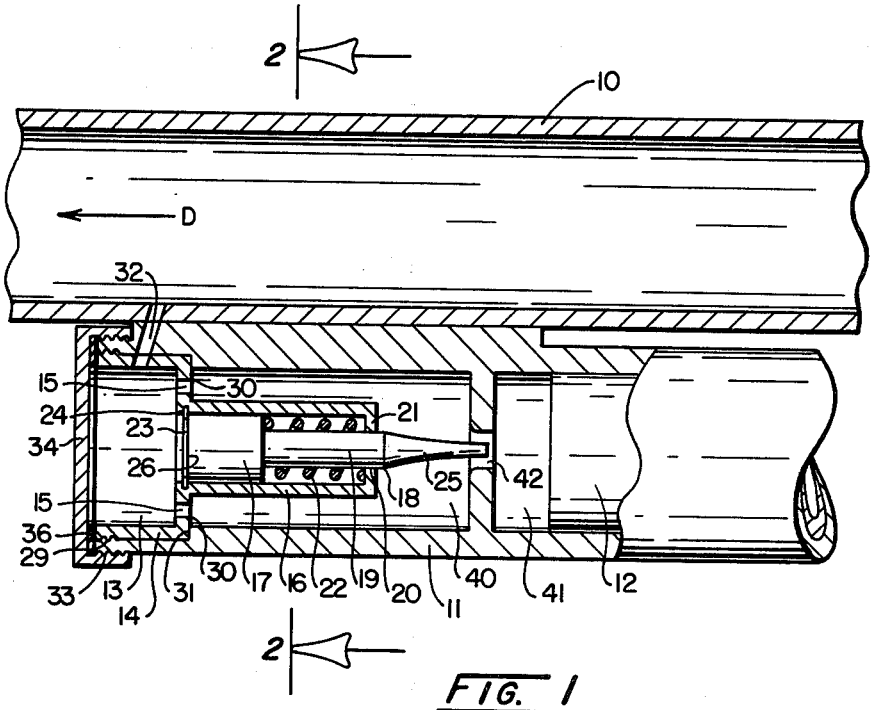
FIG. 1 is a longitudinal, cross-sectional view of the apparatus of the invention showing one embodiment affixed to the barrel of a firearm.
Figure 2:
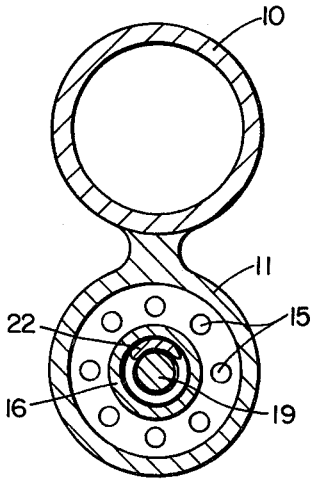
FIG. 2 is a transverse section taken along the line 2—2 in FIG. 1.

Referring to FIG. 1, a portion of barrel 10 of a semi-automatic firearm is shown. Attached parallel to and beneath the barrel 10 by known means is a cartridge magazine housing 11. The arrow D indicates the direction of the muzzle and passage of explosive gases in the barrel 10 when the firearm is fired.

A pressure sensing first chamber means 13 in the magazine housing 11 comprises a hollow cylinder 14, a plurality of gas communicating apertures 15, and a second hollow cylinder portion 16 having a smaller diameter than the first hollow cylinder 14. The second cylinder portion 16 contains a longitudinally moveable, first piston 17 in combination with a protruding stem 18 having a tapered end portion 25. The protruding stem 18 has a guide portion 19 which moves reciprocally in close fit through an aperture 20 in an end section 21 of the second hollow cylinder portion 16. Surrounding the guide portion 19 of the stem 18 within the second hollow cylinder 16 and between the first piston 17 and the interior surface of the end section 21 is an elastic metal spring means 22. A washer-like retainer 23 is inserted in the opposite end of the second hollow cylinder 16 and held in a groove 24 preventing the escapement of the piston 17 while maintaining fluid communication through its center between the gas pressure in the first chamber 13 and the head end 26 of the first piston 17.

The first piston 17 and stem 18 combination, as well as the other parts of the pressure sensing first chamber means 13 enumerated and described in this preferred embodiment, are coaxial and cylindrical or symmetrical relative to a common longitudinal axis.

The entire apparatus of the pressure sensing first chamber means 13 is inserted coaxially within the cartridge magazine housing 11 and secured with threads 29, or other means, such that the interior end surface 30 of the first hollow cylinder 14 contacts a shoulder 31 of the cartridge magazine 11. A gas port 32 drilled through the adjoining wall portions of the barrel 10, the cartridge magazine 11, and the first hollow chamber 13 is in alignment, allowing for the fluid communication of gas pressure from the barrel 10 into the first chamber 13.

Secured over the open end of the cartridge magazine 11 by threads 33 is a cap piece 34 which completes the enclosure of the first chamber 13. A compressible washer/seal 36 rests between the end of the cartridge magazine housing 11, the end of the pressure sensing first chamber 13 and the interior surface of the cap piece 34.

The insertion of the hollow cylinder 14 within the cartridge magazine housing 11, creates a second chamber 40 in fluid communication with the first chamber 13 through apertures 15. This second chamber 40 is in fluid communication with a third chamber 41 through an orifice 42. The elongated tapered end portion 25 of the longitudinally moveable stem 18 projects into the orifice 42, which is coaxial with the cartridge magazine 11. Within the magazine housing 11 is a piston 12 which is in contact with a spring (not shown), and accompanying reloading means (also not shown).

When a cartridge is fired in the firearm, it is thrust through the barrel 10, past the gas port 32, into which a portion of the propellent gas is bled under pressure into the first chamber 13 where it encounters the head end 26 of the first piston 17. The first piston 17 is displaced longitudinally, forcing its attached stem 18 to move longitudinally. The amount of longitudinal displace will depend upon the force of the gas on the first piston 17 against the spring 22. The tapered end 25 projects through the orifice 42 a variable amount thereby gradiently reducing the effective size of the opening of the orifice 42. Gas flowing from the first chamber 15 through apertures 15 and into the second chamber 40 will be regulated in further transfer into the third chamber 41 by governing valve created by the interaction of the tapered stem 25 and the orifice 42. The guide portion 19 of the stem fits closely within the aperture 20 preventing gas from entering into the second hollow chamber 16 of the first cylinder 14. Gas pressure permitted to flow into the third chamber 41 exerts a force against the second piston 12 causing it to slideably move longitudinally toward the breech of the firearm (not shown), thereby activating the reloading mechanism (also not shown).

In the case where the gas pressure from the exploding cartridge is low, the first piston will be displaced only slightly or not at all, which allows a maximum gas pressure to be communicated through the orifice 42 to activate the reloading mechanism. On the other hand, if the explosive gas pressure is high, the first piston 17 will be displaced significantly, causing the taped end 25 of the stem 18 to occupy a greater portion of the orifice 42 and thereby automatically reduce the gas pressure communicated to the third chamber 42 to the proper level of safe, efficient activation of the reloading mechanism by the second piston 12. Gas pressure in the first chamber 12 and the second chamber 40 will be maintained, foreclosing further reduction in propellent gas force in the barrel 10, and thereby increasing the thrust upon the cartridge just fired.

Another consequence of this sequence of action is the expulsion of all gas outward from the barrel 10 and not in the immediate vicinity of the shooter.

The level of gas pressure in the third chamber 41 and hence the position of the tapered stem 25 within the orifice 42 depends on numerous factors, among which are gas pressure in the barrel, the dimension of the gas port, the volume of the first chamber 13 which is dependent on the thickness of the gasket seal 36, the degree of elasticity of the elastic metal spring 22, the size and number of the apertures 15, the size of the orifice 42, the volume of the second and third chambers 40 and 41, and the relative taper of the elongated tapered end 25 of the stem 18. These are predetermined and permanently set by the manufacturing process and once an elastic metal spring 22 and a corresponding gasket seal 36 have been chosen by the manufacturer, no further readjustment should be necessary, providing regular cleaning, which is easily accomplished, is performed. However, changing the thickness of the gasket 36 will provide a further adjustment.

Although a preferred embodiment of the invention has been herein described, it will be understood that various changes and modifications in the illustrated and described structure can be affected without departure from the basic teachings or principles that underlie the invention. Changes and modifications of this type are therefore deemed to be circumscribed by the spirit and scope of the invention, except as the same may be necessarily modified by the appended claims or reasonable equivalence thereof.

I claim:

1. A compensating valve for a firearm with a gas operated loading mechanism comprising:

a. A gas pressure sensing first chamber means in fluid communication with a head end of a regulator first piston, which is reciprocally retained in a cylinder and biased for movement in one direction by an elastic means and biased in the opposite direction by the gas pressure in the first chamber, the first piston having a portion forming a stem of variable cross-section on the opposite end to the head end;

b. a gas regulating second chamber in gas fluid communication with the first chamber and having an orifice coaxial with the stem, the stem being positioned in the orifice, and the orifice providing communication between the second chamber and a third chamber operably containing a second piston which is connected to the loading mechanism of the firearm; and c. the stem having an elongated tapered end portion longitudinally moveable and positionable in the orifice according to pressure variations in the first and second chambers, thereby regulating the rate of gas flow and pressure in the third chamber.

2. A mechanism according to claim 1, wherein the first, second and third chambers are cylindrical and coaxial.

3. A mechanism according to claim 1, wherein the firearm has a barrel and the first chamber is in communication with the barrel.

4. A mechanism according to claim 3, wherein the elastic biasing means is a spring encircling the stem portion of the first piston.

5. A mechanism according to claim 1, wherein the first piston comprises a cylindrical head end portion which is adjacent to a cylindrical guide portion of lesser diameter that is adjacent to the stem portion, and the elastic means is a spring encircling and guided by the portion of the first piston.

6. A mechanism according to claim 1, wherein the first chamber means is formed in a hollow cylinder which fits against a shoulder in the second chamber, and is closed to the outside by a cap over the end of the first chamber.

7. In a firearm having a gas operated loading mechanism which is attached to a barrel of the firearm, the improvement comprising:

a. a gas pressure sensing first chamber means in fluid communication with a head end of a regulator first piston, which is reciprocally retained in a cylinder and bias for movement in one direction by an elastic means and biased in the opposite direction by gas pressure in the first chamber, the first piston having a portion forming a stem of variable cross-section on the opposite end to the head end, the elastic biasing means being a spring encircling the stem portion of the first piston;

b. a gas regulating second chamber coaxial with and in gas fluid communication with the first chamber and having an orifice coaxial with the stem, the stem being positioned in the orifice and the orifice providing communication between the second chamber and a third chamber, the third chamber being coaxial with the first and second chambers and operably containing a second piston which is connected to the loading mechanism of the firearm;

c. the first piston comprising a cylindrical head portion which is adjacent to a cylindrical guide portion of lesser diameter that is adjacent to the stem portion, and the spring being guided by a guide portion of the first piston, the guide portion being located between the piston and the stem; and d. the stem having an elongated tapered end portion longitudinally moveable and positionable in the orifice according to pressure variations in the first and second chambers, thereby regulating the rate of gas flow and pressure in the third chamber according to the size of the powder load discharged in the barrel.

* * * * *